United States Patent [19]

Jenne

[11] Patent Number: 5,050,686

[45] Date of Patent: Sep. 24, 1991

[54] PERCUSSION DRILL

[75] Inventor: Dietmar Jenne, Strengelbach, Switzerland

[73] Assignee: Terra Ag fuer Tiefbautechnik, Strengelbach, Switzerland

[21] Appl. No.: 458,954

[22] Filed: Dec. 29, 1989

[30] Foreign Application Priority Data

Jan. 12, 1989 [CH] Switzerland ..... 89/89

[51] Int. Cl.[5] ..... B25D 9/00

[52] U.S. Cl. ..... 173/91; 175/19

[58] Field of Search ..... 173/91, 134, 90; 91/234; 175/19

[56] References Cited

U.S. PATENT DOCUMENTS 4,683,960 8/1987 Kostylew et al. ..... 173/91

4,708,211 11/1987 Shenyakin et al. ..... 173/91 X

*Primary Examiner*—Timothy V. Eley

*Assistant Examiner*—Willmon Fridie, Jr.

*Attorney, Agent, or Firm*—Trexler, Bushnell, Giangiorgi & Blackstone, Ltd.

[57] ABSTRACT

A percussion drill having a control device for controlling its travel forwards and/or backwards is provided with an adjusting and locking device for an axially movable control sleeve (4), this adjustment reversal device being adapted to be controllably operated with compressed air from a control station. A reliable reversal from forward to backward travel of the percussion drill is thus possible even in very long boreholes and even in the event of the collapse of the borehole.

6 Claims, 5 Drawing Sheets

PERCUSSION DRILL

The invention relates to a percussion drill having a control device for controlling its backward travel, according to the preamble of claim 1.

A percussion drill of this type is for example known from DE 1634417- INSTITUT GORNOGO, which has a striker disposed in a casing and transmitting percussion impulses to the casing as it makes its reciprocating movement under the action of compressed air, the striker being provided in its rear part with an open cavity having transverse bores which are disposed at the same height in the side wall and which on the movement of the striker are regularly covered by a two-stage control sleeve situated in the rear part of the casing and connected to the compressed air pipe, while an adjusting device is provided for adjusting the control sleeve in the axial direction, the control sleeve having a stop and being adapted to be brought into operative connection with a flange which cooperates with said stop and which is screwed into the casing of the percussion drill. In this arrangement the control sleeve is screwthreadedly connected to the casing and is accordingly axially adjusted when turned. The control sleeve can thus be brought into different axial positions and thus into different control positions in the end positions of the screwthread. The adjustment of the control of the control sleeve, and thus a change of the direction of travel of the percussion drill (that is to say a change between forward and backward travel), is achieved by disconnecting the compressed air hose from the compressed air compressor, then turning the compressed air hose a number of times so that the control sleeve is screwed from stop to stop, and reconnecting the compressed air hose.

In a variant of this arrangement the adjusting device consists of two parts sprung and movable on a stationary bush connected to the casing, the inner of said parts being connected to the casing, the inner of said parts being connected to the compressed air hose and the outer part being movable on the bush through the internal pressure of the compressed air, against the action of an external spring, and having control edges for controlling the movement of the striker. In order to lock the outer part in its forward travel or backward travel position, the bush is provided, near its front end, with a ball catch which on the one hand engages in a recess in order to lock the outer part in its front position and, on the other hand, in a recess formed in the control sleeve and provided with a clamp surface, in the front position, defined by the inner spring, of said control sleeve. This position of the components defines the control position for forward travel of the percussion drill.

In order to obtain the control position for backward travel of the percussion drill, the compressed air hose must be pulled with a jerk, whereby the ball catch is released from the clamp surface and rolls into the recess in the inner part. The outer part is thus no longer held and, because of the air pressure prevailing in the interior and acting on it, is likewise moved axially in the direction in which the hose was pulled. The external spring is thereby compressed. As long as the internal pressure of the compressed air is maintained, the outer and inner parts retain their positions relative to the control sleeve because of the clamp action of the ball catch loaded by the internal spring. In order to change back to the control position for forward travel, the compressed air supply must be cut off for a short time, so that the outer part moves into its other control position through the action of the external spring and is once again held in that position by the ball catch engaged in its recess.

Adjustment to the first control position (of the outer part) is thus effected by pulling the compressed air hose (and the consequent movement of the outer part through the working air pressure inside the system), and the other adjustment to the second control position (of the outer part) is thus effected by cutting off the supply of working compressed air.

This control procedure and these control devices have the considerable disadvantage that in the event of unintentional interruption of the supply of working compressed air, such as continually occurs on a building site under rough site conditions, the percussion drill will be changed over from backward to forward travel, which will lead to delays in the work and unprofitable readjustments, and consequently to inefficient working.

In another percussion drill (DE 28 00 050- WINTER two pistons are disposed in an axially staggered arrangement on a slide provided with a central axial bore and lie in corresponding cylinders in a part of the percussion drill casing. The inner end of the slide projects into a recess in a hammer, which is driven by the compressed air flowing through the central axial bore in the slide. This compressed air is fed to the slide at its outer end by means of a compressed air hose attached to it. Radial bores are disposed in the slide, close to the pistons of the latter, and connect the axial bore to the cylinders in which the pistons lie.

If compressed air is supplied through the compressed air hose, it will pass through the axial bore on the one hand behind the hammer and on the other hand, through the radial bores, behind the two staggered pistons of the slide. This has the effect that on the one hand the hammer is accelerated towards the tip of the percussion drill and that on the other hand the slide is moved in the same direction inside the two staggered cylinders to the end of the stroke, to reach a first control position for the hammer and the forward travel of the percussion drill.

If the percussion drill is to be changed over to backward travel, the supply of compressed air is cut off and the hose is pulled to move the slide from its first to a second control position at the other end of the stroke in the cylinder. In this position the radial bores to one of the staggered cylinders are closed, so that when the compressed air supply is turned on again the adjusting force on the slide through the action of one of the staggered pistons is smaller than the reaction force acting on the slide because of the compressed air behind the hammer. The slide is therefore held in its second control position, which brings about the backward travel of the percussion drill.

This percussion drill also has the disadvantage described in connection with the first percussion drill, namely unintentional reversal of the adjustment if the compressed air hose is pulled unintentionally and interruption of the compressed air supply occurs.

Both percussion drills have the fundamental disadvantage that reversal of the adjustment must be made by turning or pulling the compressed air hose. This is bad. In the case of a collapsing borehole, for example, that is to say if rock and earth fall from a great height onto the compressed air hose, it is no longer possible to pull or turn the latter in order to make the changeover. The percussion drill must be recovered by hand or with other machines.

The great length of the hoses that is usual and the elasticity of the hose material, particularly when the hose is very long, do not allow the pulling or turning of the hose to be transmitted from the control station to the percussion drill deep in the borehole. The dead weight of the hose also makes it difficult or impossible to transmit such control movements.

Weather conditions constitute an additional factor, the hose becoming slippery in wet weather, so that because of the friction, which nonetheless occurs in the borehole because of the weight of the hose, the latter cannot be moved by turning or pulling for the purpose of changing the adjustment.

In particular, a change of adjustment by pulling or turning the hose can no longer be reliably achieved when the hose has a length of more than 10 meters. With hose lengths greater than 50 meters, experience has shown that such changes are entirely impossible.

Reversal devices utilizing a spring to make one of the control movements also have the same shortcomings, as well as others. In particular, in the case of collapsed boreholes, spring forces are no longer sufficient to move a hose clamped in the earth. It is also a disadvantage that the spring would have to be designed for the greatest possible resistance to restoration that would have to be overcome, if restoration is to be reliably achieved.

The invention therefore seeks to provide a percussion drill having a reversal control that avoids the shortcomings of devices of the prior art, that is to say in which the reversal control is substantially free from spring forces or externally exerted forces and reversal can be controlled very accurately with the aid of control means. This must also be possible in the event of fluctuating or pulsating operating pressure of the compressed air.

This aim can be achieved according to the invention by applying the features of claim 1. In addition, the features of claims 2 to 14 can be applied.

Further details and features of the invention will appear from the following description of examples of the invention, which is given with reference to the drawings, in which.

Figure 1:
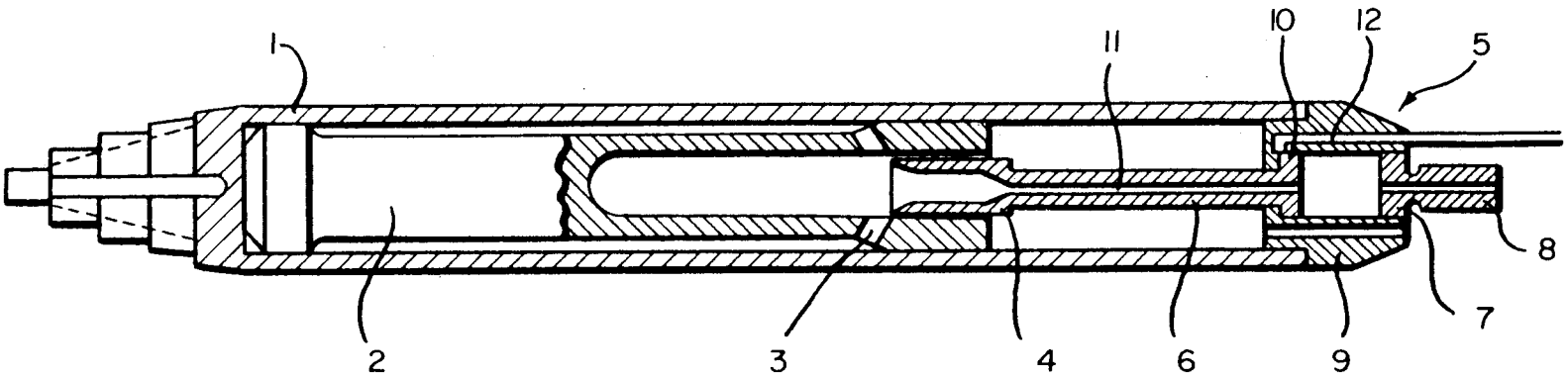
FIG. 1 is a cross-section of a percussion drill.
Figure 2:
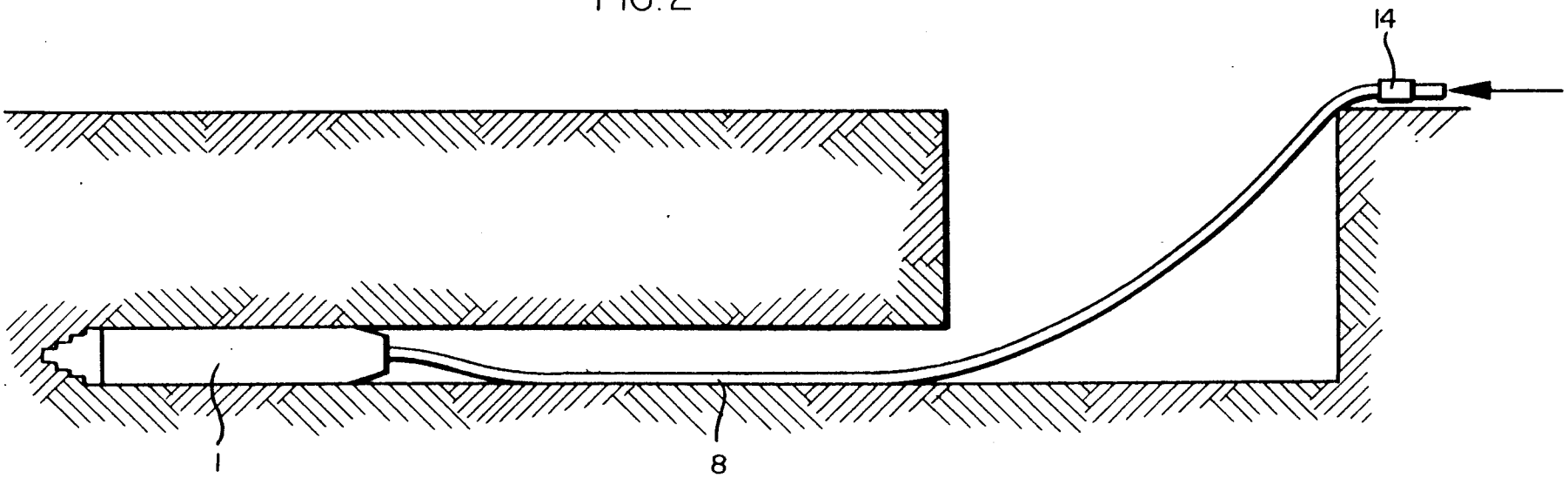
FIG. 2 illustrates the situation when a percussion drill is in use.

In a first variant (FIG. 3) of a control device for a percussion drill, a casing 1 of the drill contains a percussion piston 2 into whose rear end, which is provided with radial control openings 3, a coaxially disposed control element in the form of a control sleeve 4 projects, the sleeve 4 being connected to an adjusting and locking device 5, which in turn is screwed into the casing 1.

The adjusting and locking device 5 is provided with a connecting member 6, which is for example in the form of a spacer tube connected at one end to the control sleeve 4 and at the other end to a piston-cylinder unit provided with a hose connector 7 for a working compressed air hose 8. In particular, said piston-cylinder unit is in the form of a double-acting piston-cylinder unit comprising a cylinder casing 9 containing a double-acting piston 10 which is connected by means of the connected rod 6 to the control sleeve 4. The piston 10, the connecting rod 6 and the control sleeve 4 have a central bore 11 for the passage of working compressed air into the region behind the percussion piston 2, for the purpose of driving the latter. This working air passes from the hose and via the hose connector 7 into the cylinder casing 9 and, depending on the position of the piston—that is to say depending on the side on which the piston is pressurized, passes directly or indirectly through the central bore 11 in the connecting rod 6 to the control sleeve 4 and to the percussion piston 2. Depending on the position of the double-acting piston 10 in the cylinder casing 9, and consequently the position of the control sleeve 4, the percussion piston 2 is driven by the working compressed air to strike against the front end of the casing 1 or against the rear end of the casing 1, that is to say for the forward travel or backward travel of the percussion drill. To ensure better filling of the cylinder, the piston 10 may be provided with radial air passages 13.

Assuming that the control sleeve 4 is in the forward travel control position, the double-acting piston 10 is correspondingly situated at the end of the cylinder remote from the hose connector 7. The cylinder casing 9 contains a control compressed air duct 12, which in the region of the cylinder end face at the connecting rod end leads into the cylinder and applies control air pressure onto the face of the piston 10 at the connecting rod end.

It will be assumed that the working cycle starts with the piston situated at the hose connector end.

If working compressed air is supplied to the air hose 8, it flows on the one hand via the radial air distribution passages 13 into the cylinder 9 and on the other hand along the central bore 11 through the piston 10 and the connecting rod 6 into the region of the control sleeve 4, where it acts on the percussion piston 2. Through the compressed air in the cylinder 9 the piston 10 is moved until it strikes against the cylinder wall at the connecting rod end, where it is held by the working air pressure, since the face of the piston 10 exposed to the working air pressure is larger than the end face of the control sleeve 4. The control sleeve is therefore in the forward travel position and the percussion drill advances into the ground.

When the percussion drill has to be changed over from forward travel to backward travel, the control air duct 12 is supplied with control compressed air by means of a control valve 14 which is disposed at a control station and which may be a multiway valve. The control air passes in front of the piston 10 into the cylinder 9 at the connecting rod end, and moves the piston 10 back to its end position at the hose connector end. The control sleeve is thereby also moved into its backward travel position and the working air now passes directly out of the hose connector 7 into the central bore 11 of the connecting rod 6 and into a rear working compressed air chamber, which is formed by the internal bore of the percussion piston 2 and the control sleeve 4, and behind the percussion piston 2. Because of the backward travel position of the control sleeve 4, the percussion piston 2 is loaded with working air pressure for the backward travel of the percussion drill out of the borehole For a new forward travel cycle the air pressure in the control pressure duct must be reduced until the working air pressure in the cylinder rises and is once again able to move the piston 10.

Figure 3:
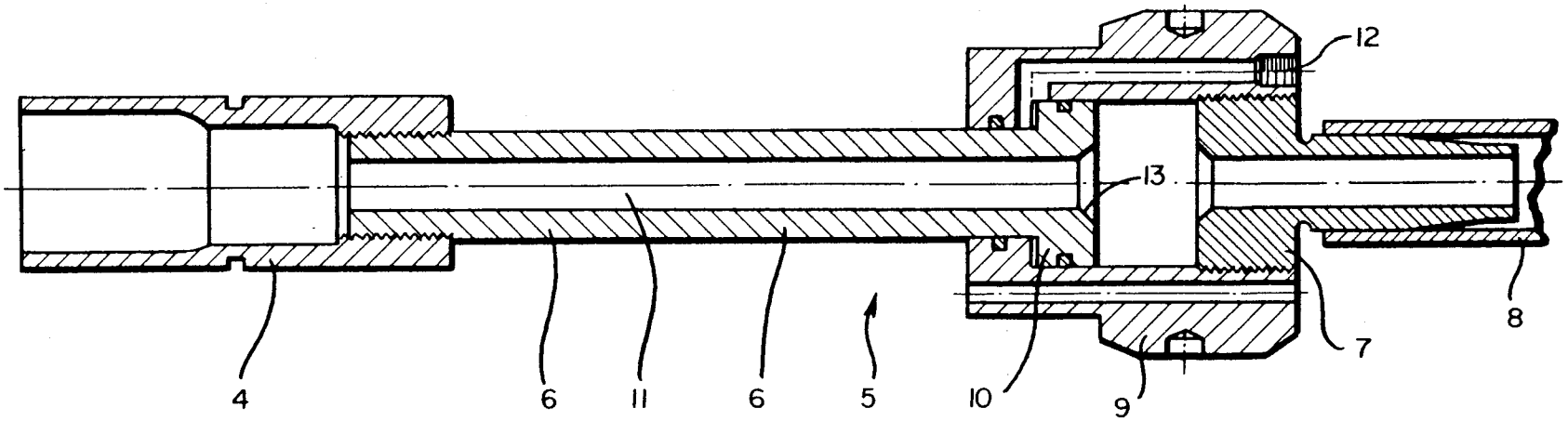
FIG. 3 shows control means in a first version in a percussion drill of the form shown in FIG. 1, in the forward travel position.
Figure 4:
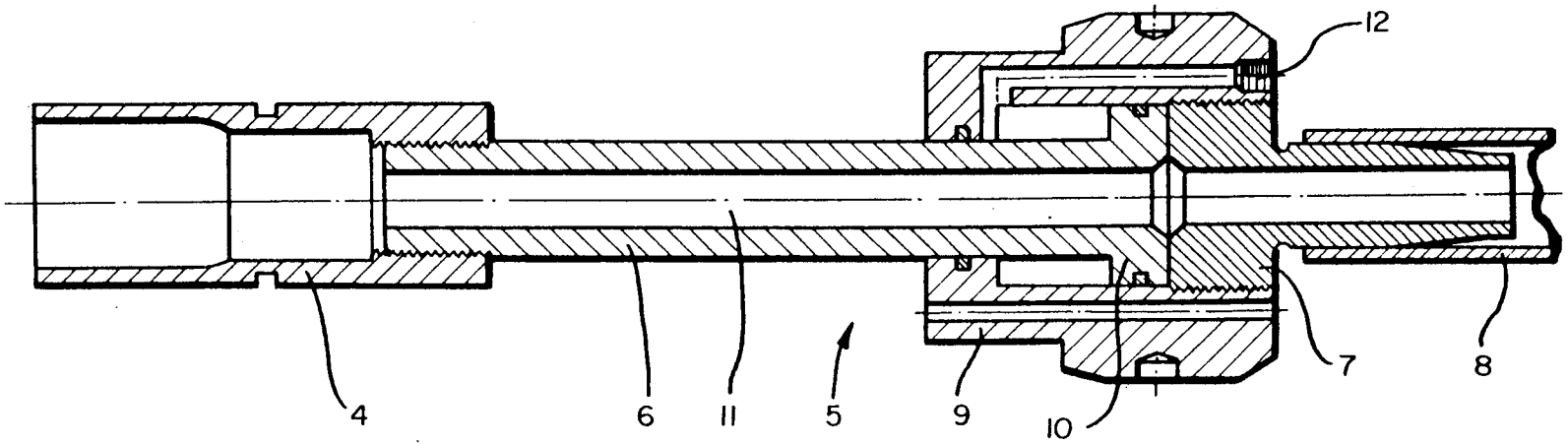
FIG. 4 shows control means in a first version in a percussion drill of the form shown in FIG. 1, in the background travel position.
Figure 5:
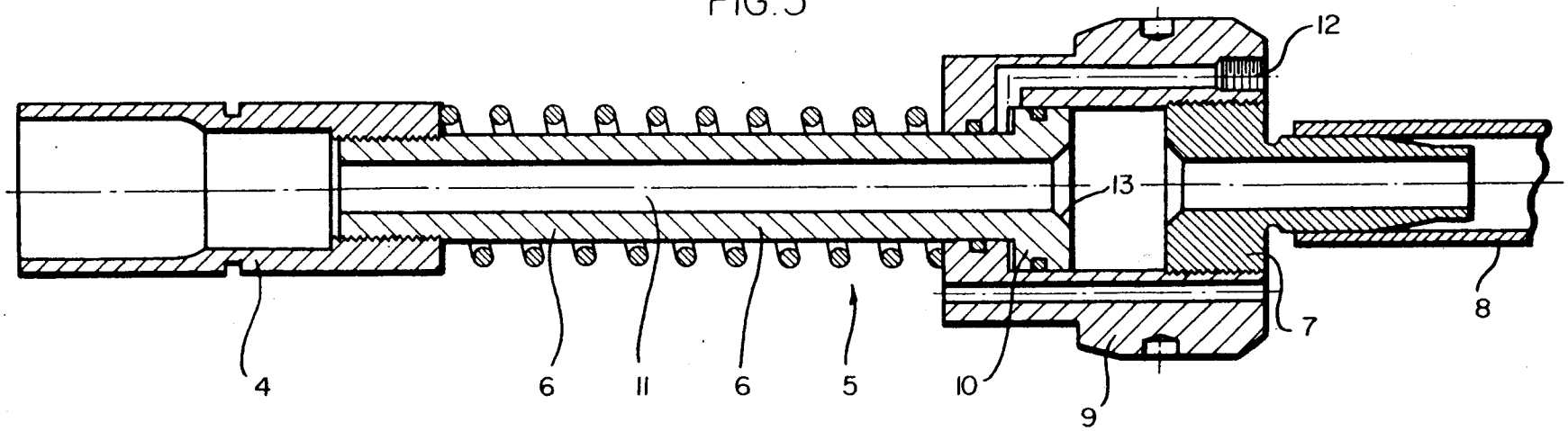
FIG. 5 shows control means in a second version in a percussion drill of the form shown in FIG. 1, in the forward travel position.
Figure 6:
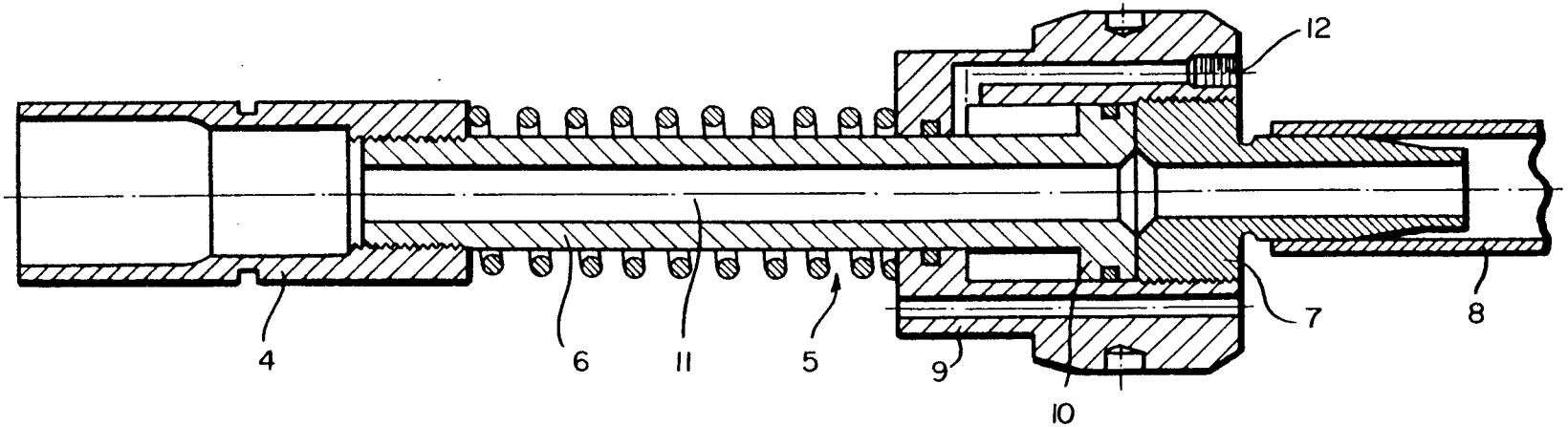
FIG. 6 shows control means in a second version in a percussion drill of the form shown in FIG. 1, in the backward travel position.
Figure 7A:
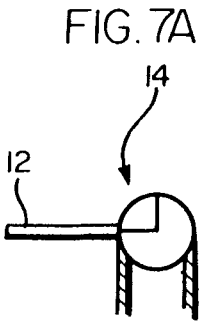
FIG. 7 shows control means for the reversal control at the control point of the percussion drill, in a first variant.
Figure 7:
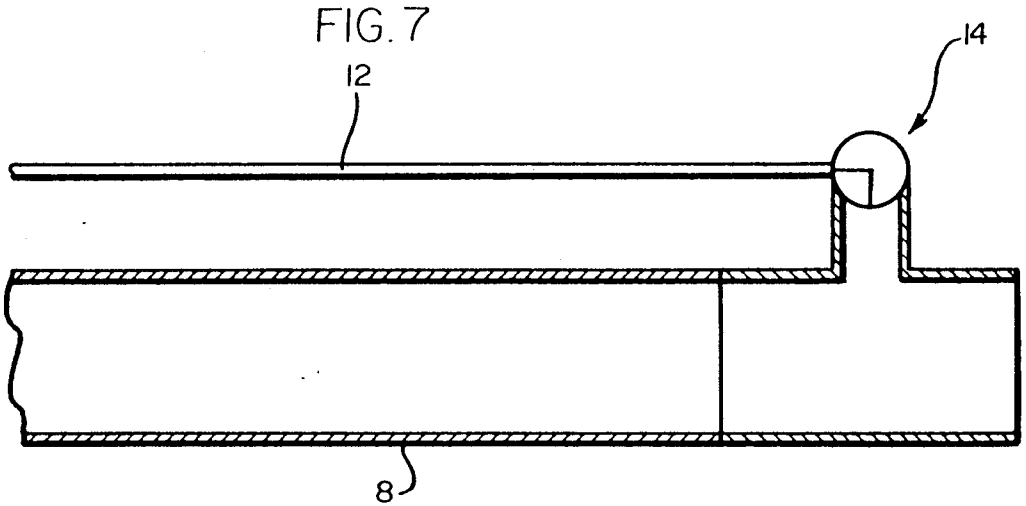
Figure 8A:
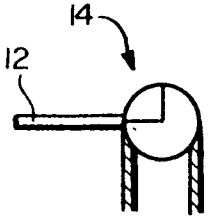
FIG. 8 shows control means for the reversal control at the control point of the percussion drill, in a second variant.
Figure 8:
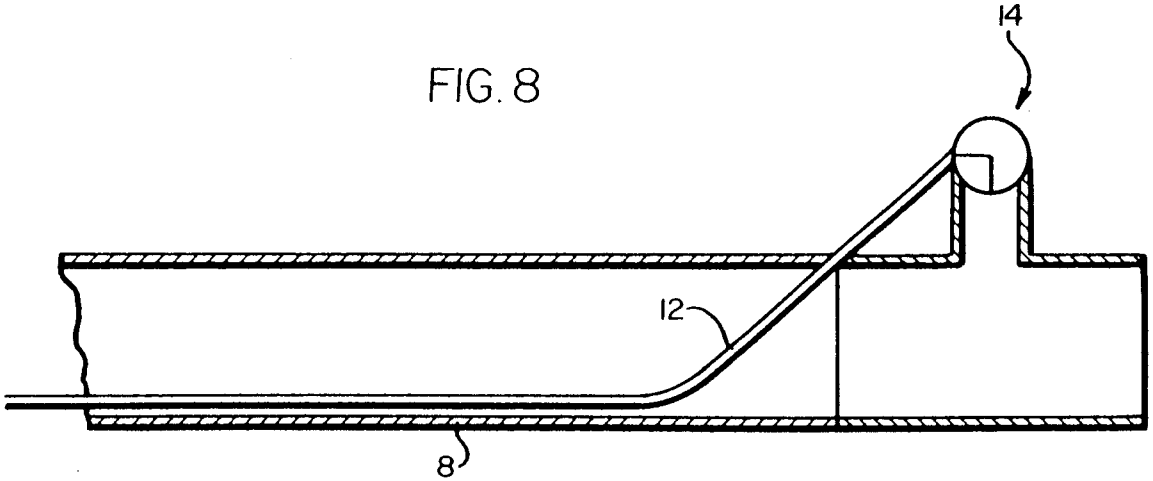
Figure 9B:
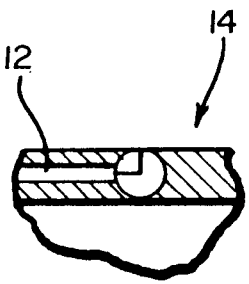
FIG. 9 shows control means for the reversal control at the control point of the percussion drill, in a third variant.
Figure 9:
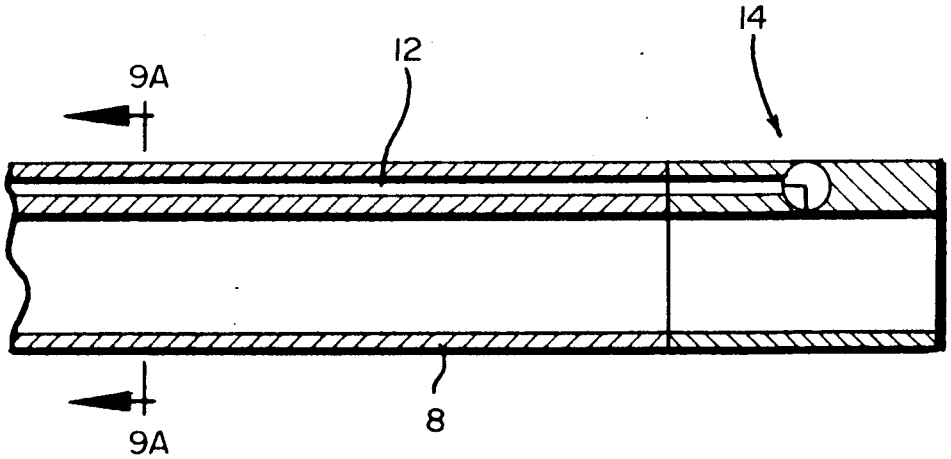
Figure 9A:
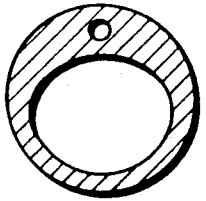

A second variant of an adjusting and locking device 5 (FIGS. 5 and 6) is substantially of the same construction as variant 1 shown in FIG. 3, but a spring 15 is additionally provided coaxially to and around the connecting rod 6, this spring here being by way of example a compression spring, supported at one end against the cylinder casing 9 and at the other end against the control sleeve 4. The compression spring 15 exerts on the piston 10 a force which is added to the force exerted on it by the working air pressure and therefore holds the piston, and thus also the control sleeve, in the control position for forward travel irrespective of any pulsation or irregularity of the force of the working air pressure.

Fluctuations of the working air pressure, in conjunction with the movements of the percussion drill itself, thus have no effect on the maintenance of the control position of the control sleeve 4. In other words, no unintentional reversals or oscillations of the control system occur.

The reversal from forward travel to backward travel of the percussion drill is once again effected by supplying compressed air to the control air duct 12 from the control station with the aid of a control valve 14. The pressure of the control air on the face of the piston 10 to which it is applied must now be adapted to the force of the compression spring 15 which must additionally be overcome. Otherwise the second variant functions like the first variant of adjusting and locking device or reversal device.

Figure 10A:
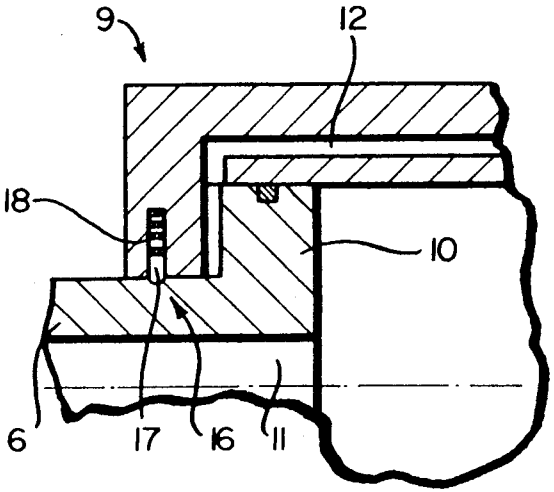
FIG. 10 shows details of a reversal control device.
Figure 10:
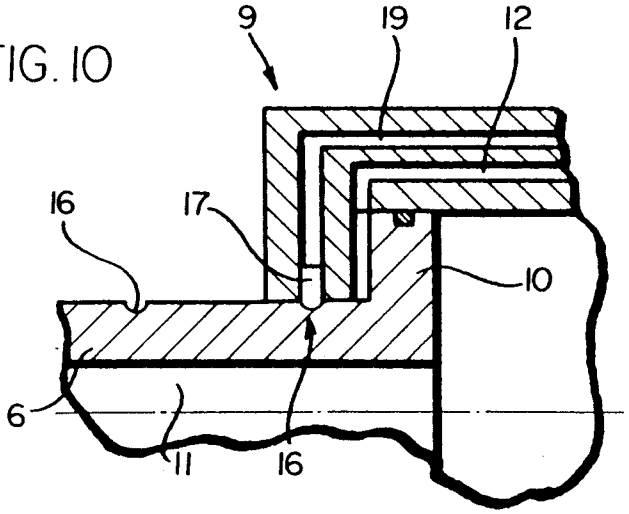

A third variant of a reversal device (FIG. 10) is once again substantially of the same construction as the adjusting and locking device 5 in the first or second variants. However, in the region of the piston 10 the connection rod 6 is provided with at least one latching recess 16 cooperating with a latch pin 17 disposed in the cylinder casing 9. This latch pin 17 may be loaded either by a spring 18 or with compressed air via a locking air duct 19, in order to press the pin into the latching recess in the connecting rod 6, and thus to hold the connecting rod 6, and therefore also the control sleeve 4, in one of the two control positions for forward or backward travel. When the latch pin 17 is pressurized with compressed air, the locking air is supplied or cut off in dependence on the position of the piston. This can be achieved with the aid of a suitably designed control valve in conjunction with the regulation of the control air supply.

The reversal device disclosed has the decisive advantage that at least one embodiment is possible which, while using a minimum of closable components, nevertheless ensures a quality and reliability of control exempt from disturbance to an extent not hitherto achieved. In this device disturbances, such as compressed air fluctuations in the air lines, caused by the particular nature of the compressor systems, and also malfunctioning due to dirt or wear are eliminated. Impairment or failure of the reversal function because of a collapsed borehole is likewise avoided. Moreover, compressed air hoses not provided with reinforcement may be used. The operational reliability of the reversal control is also not lost or impaired by the length of the hose, because the increase in friction against the inner wall of the borehole resulting from increased length, and the angles of twist, which are sharply increased because of the elasticity of the hose, have no effect during the reversal operation.

I claim:

1. A percussion drill having an axially adjustable control device for controlling forward and backward travel, said drill including an adjusting and locking device connected to said control device; said adjusting and locking device including a double-acting piston-cylinder unit and a first and second compressed air line in communication with said double-acting piston-cylinder unit; said double-acting piston-cylinder unit including a cylinder chamber having a piston operatively retained therein, said piston having a first and a second side; said first air line communicating with said double-acting piston-cylinder unit on said first side of said piston for controlling said axially adjustable control device for driving said percussion drill in a forward direction; said second air line controllably communicating with said double-acting piston cylinder unit on said second side of said piston for controlling said axially adjustable control device for driving said percussion drill in a reverse direction; a control valve in communication with said first and second air lines selectively controlling the direction of movement of said percussion drill.

2. A percussion drill according to claim 1, wherein said axially adjustable control device is attached to said second side of said piston, said cylinder chamber being mounted in a casing portion of said percussion drill and including a top surface and a bottom surface at each end thereof, a first chamber of said cylinder chamber defined between said first side of said piston and said top surface of said cylinder, a second chamber defined between said second side of said piston and said bottom of said cylinder chamber, said first air line communicating with said first chamber and said second air line communicating with said second chamber.

3. A percussion drill having an axially adjustable control device for controlling the forward and backward travel direction of said drill and an adjusting and locking device connected to said control device for selectively controlling said control device, said adjusting and locking device comprising: a double-acting piston-cylinder unit including a cylinder chamber and a piston retained therein, said piston being operatively retained and axially movable in said cylinder chamber and attached to said control device for moving said control device to change the direction of travel of said drill, and first and second air lines controllably communicating with said cylinder chamber for controllably moving said piston to change the direction of travel of said drill.

4. A percussion drill according to claim 3, further including a control valve controllably communicating with said first and second air lines for controllably regulating air flow from said air lines into said double-acting piston-cylinder unit.

5. A percussion drill according to claim 3, wherein said cylinder chamber has a top surface and a bottom surface, said piston operatively positioned in said chamber having a first side and a second side, a first chamber defined between said first side of said piston and said top surface of said cylinder chamber, a second chamber defined between said second side of said-piston and said bottom surface of said cylinder chamber, said first air line communicating with said first chamber and said second air line communicating with said second chamber, a control valve controllably communicating with said first and second air lines for controllably regulating air flow from said air lines into said first and second chambers; said first air line controllably exerting pneumatic forces upon said first side of said piston for operating said drill in a forward direction when said control valve is only in communication with said first air line; said second air line exerting pneumatic forces on said second side of said piston for operating said drill in a reverse direction when said control valve is in communication with said second air line.

6. A percussion drill according to claim 3, wherein said drill generally forms a hole into the ground and said control valve is positioned external to said hole.

* * * * *

UNITED STATES PATENT AND TRADEMARK OFFICE

CERTIFICATE OF CORRECTION

PATENT NO. : 5,050,686

DATED : September 24, 1991

INVENTOR(S) : Dietmar Jenne

It is certified that error appears in the above-identified patent and that said Letters Patent is hereby corrected as shown below:

Column 1, Line 2 " control device for controlling its backward travel, "

it should read — control device for controlling its forward and/or backward travel, —

Signed and Sealed this

Second Day of March, 1993

*Attest:*

STEPHEN G. KUNIN

*Attesting Officer*

*Acting Commissioner of Patents and Trademarks*